US007223910B2

(12) United States Patent
Shimada

(10) Patent No.: US 7,223,910 B2
(45) Date of Patent: May 29, 2007

(54) SNARE DRUM

(75) Inventor: Masahiro Shimada, Seto (JP)

(73) Assignee: Hoshino Gakki Mfg. Co., Ltd. (JP)

( * ) Notice: Subject to any disclaimer, the term of this patent is extended or adjusted under 35 U.S.C. 154(b) by 253 days.

(21) Appl. No.: 11/020,769

(22) Filed: Dec. 23, 2004

(65) Prior Publication Data

US 2005/0241457 A1 Nov. 3, 2005

(30) Foreign Application Priority Data

Apr. 19, 2004 (JP) ..... 2004-123365

(51) Int. Cl.
*G10D 13/02* (2006.01)

(52) U.S. Cl. ..... 84/415

(58) Field of Classification Search ..... 84/415
See application file for complete search history.

(56) References Cited

U.S. PATENT DOCUMENTS

| | | | | | |
|---|---|---|---|---|---|
| 382,045 | A | * | 5/1888 | Lehnert | 84/415 |
| 389,594 | A | * | 9/1888 | Plowe | 84/417 |
| 1,442,833 | A | * | 1/1923 | Soderberg | 84/415 |
| 1,585,655 | A | * | 5/1926 | Elliott | 84/415 |
| 1,595,764 | A | * | 8/1926 | Elliott | 84/415 |
| 1,619,046 | A | * | 3/1927 | Ward | 84/415 |
| 1,724,888 | A | * | 8/1929 | Strupe | 84/415 |
| 1,828,083 | A | * | 10/1931 | Strupe | 84/415 |
| 1,832,227 | A | * | 11/1931 | Ludwig | 84/415 |
| 2,096,209 | A | * | 10/1937 | Strupe | 84/415 |
| 2,621,554 | A | * | 12/1952 | Way | 84/415 |
| 3,113,481 | A | * | 12/1963 | Thompson | 84/415 |
| 3,981,220 | A | * | 9/1976 | Clark | 84/415 |
| 4,018,130 | A | * | 4/1977 | Gariepy, Sr. | 84/415 |
| 4,138,920 | A | * | 2/1979 | Meador | 84/415 |
| 4,246,825 | A | * | 1/1981 | Hodas | 84/415 |
| 4,383,467 | A | * | 5/1983 | Glassford, Jr. | 84/415 |
| 4,583,442 | A | * | 4/1986 | Minor | 84/413 |
| 4,787,286 | A | * | 11/1988 | Okumura | 84/417 |
| 4,869,146 | A | * | 9/1989 | Bonsor | 84/413 |
| 4,967,634 | A | * | 11/1990 | Whynott | 84/413 |
| 5,410,938 | A | * | 5/1995 | Kurosaki et al. | 84/411 R |

(Continued)

FOREIGN PATENT DOCUMENTS

DE 3504024 A1 * 10/1985

(Continued)

*Primary Examiner*—Lincoln Donovan
*Assistant Examiner*—Robert Horn
(74) *Attorney, Agent, or Firm*—Ostrolenk, Faber, Gerb & Soffen, LLP

(57) ABSTRACT

A snare drum including a drum shell having an upper head and a lower head mounted thereon and a frame for holding a plurality of snare wires. The frame arranges the snare wires to be in contact with the lower head or to be spaced from the lower head. The snare drum includes a first latched member and a second latched member respectively located at opposite ends of the frame at an outer side the drum shell. An attachment mechanism is located on the drum shell for arranging the frame on a surface of the lower head. The attachment mechanism includes a first latching member and a second latching member arranged between the drum shell and the first and second latched members for separably latching the first and second latched members, respectively.

12 Claims, 13 Drawing Sheets

U.S. PATENT DOCUMENTS 5,447,087 A * 9/1995 Hawes et al. ..... 84/413
5,557,053 A * 9/1996 Nickel ..... 84/415
5,616,875 A * 4/1997 Lombardi ..... 84/415
6,008,445 A * 12/1999 Chen ..... 84/415
6,020,547 A * 2/2000 Chen ..... 84/415
6,091,010 A * 7/2000 Gauger ..... 84/415
6,093,877 A * 7/2000 Nickel ..... 84/415
6,172,288 B1 * 1/2001 Freer ..... 84/411 R
6,441,287 B1 * 8/2002 Crouch et al. ..... 84/415
6,689,944 B1 * 2/2004 Okumura ..... 84/411 R
6,846,978 B2 * 1/2005 Dorfman et al. ..... 84/415
6,867,355 B2 * 3/2005 Okamoto ..... 84/415
6,891,098 B1 * 5/2005 Lombardi ..... 84/415
6,958,440 B2 * 10/2005 Yu-Hwa ..... 84/415
7,151,211 B2 * 12/2006 Whittington et al. ..... 84/415

FOREIGN PATENT DOCUMENTS

FR 2837318 A1 * 9/2003
JP 55-167283 12/1980
JP 57-185487 11/1982
JP 58-152692 10/1983
JP 60-90497 6/1985
JP 43-22073 9/1988
JP 11-875 1/1999
JP 2000-293166 10/2000

* cited by examiner

SNARE DRUM

BACKGROUND OF THE INVENTION

The present invention relates to a snare drum, and more particularly, to a snare drum of a type having a plurality of snare wires held by a frame.

A snare drum having a plurality of snare wires on a lower head face is known in the prior art (see U.S. Pat. No. 1,832,227).

FIG. 19 is a perspective view showing a snare wire unit 211 of a first prior art example. FIG. 20 is a view of a snare drum 200 to which the snare wire unit 211 is attached, as seen from the lower side of the drum 200. As shown in FIG. 19, the snare wire unit 211 has a plurality of snare wires 201, and a right metal holder 202 and a left metal holder 203 for holding opposite ends of the snare wires 201. In the prior art snare drum 200, the metal holders 202 and 203 are respectively inserted into and fastened to a right connector 205 and a left connector 206, which are located on a lower hoop 204 of the drum 200. The right connector 205 has an opening in its right face so that the snare wire unit 211 can be inserted into and removed out through the opening. A threaded hole (not shown) is formed in the left face of the left metal holder 203. A bolt 207 provided in the left connector 206 is engaged with the threaded hole to fasten the left metal holder 203 and the left connector 206 together to each other. Further, a switch 210 is connected to the left connector 206 for bringing the snare wires 201 close to the lower head 209.

To remove the snare wire unit 211 from the snare drum 200, the bolt 207 is first loosened and the left metal holder 203 is pulled in the rightward direction out of the left connector 206. The right metal holder 202 is then pulled in the rightward direction out of the right connector 205. To attach the snare wire unit 211 to the snare drum 200, the left metal holder 203 is first inserted through the right connector 205 from the right side to the left side. Then, the left metal holder 203 is inserted into the left connector 206 from the right side to the left side. The bolt 207 is then tightened to fasten the left metal holder 203 to the left connector 206. This also fastens the right metal holder 202 to the right connector 205 The snare wire unit 211 is attached to the snare drum 200 in this manner.

There is a second prior art example, in which snare wires are held by a frame and the frame is supported by a string on the drum (see U.S. Pat. No. 3,113,481). To remove a snare wire unit, which includes a plurality of snare wires and the frame, from the snare drum, the string is first loosened. Then, the unit is detached from the drum.

Detachment and attachment of the snare wire unit becomes necessary when replacing, for example, a lower head or individual snare wires. In the first and second prior art examples, however, a series of tasks as described above must be performed to detach and attach the snare wire unit. These tasks are complicated and troublesome.

Further, in the first prior art example, once the snare wire unit 211 is removed, the tension of the snare wires 201 drops to zero. This means that the adjusted tension before detachment of the snare wire unit 211 cannot be maintained. Thus, tension adjustment must be performed again after the attachment. It is inefficient and troublesome to perform tension adjustment every time the snare wire unit is detached and attached. Moreover, since the fastening with the bolt 207 of the left connector 206 applies tension to the snare wires 201 in addition to fixing the left metal holder 203 to the left connector 206, the tension of the snare wires 201 is directly applied to the switch 210 and the body of the drum 200. This results in various problems, such as much strength being required to operate the switch 210 and deformation of the drum body occurring.

Further, the opposite ends of the plurality of snare wires 201 are all fixed to the metal holders 202 and 203 so that the snare wires 201 do not become scattered when the snare wire unit 211 is detached from the drum. Therefore, the snare wires cannot be replaced individually. The number of the snare wires is usually about ten to fourteen. However, when there is no need to use, for example, four to eight snare wires, the unnecessary snare wires must be cut off. However, once the wires are cut off, it is impossible to restore the cut off wires when the original number of snare wires becomes necessary.

The second prior art example differs from the first prior art example in that the snare wires are held by the frame and the tension of the snare wires is thus maintained even after detachment of the snare wire unit. However, the string fastens the frame to the drum. Thus, it is difficult to adjust the position of the string accurately. Consequently, there is a problem in that a slight difference in the position of the snare wire unit before and after the detachment occurs. Further, especially when the snare drum is used as a marching snare drum, there is a problem in that the string is often broken due to heavy vertical and horizontal swaying motions during usage of the drum.

It is an object of the present invention to provide a snare drum which eliminates the need for tension adjustment when reattaching snare wires which have been detached and which simplifies the attachment and detachment of snare wires to a drum. A further object of the present invention is to provide a snare drum that enables snare wires to be replaced individually.

SUMMARY OF THE INVENTION

To achieve the above objects, the present invention provides a snare drum for use with a plurality of snare wires. The snare drum includes a drum shell having an upper head and a lower head mounted thereon, an outer side, and a frame for holding the plurality of snare wires. The frame arranging the snare wires to be in contact with the lower head or to be spaced from the lower head. The snare drum includes a first latched member and a second latched member respectively located at opposite ends of the frame at the outer side of the drum shell. An attachment mechanism is located on the drum shell for arranging the frame on a surface of the lower head. The attachment mechanism includes a first latching member and a second latching member arranged between the drum shell and the first and second latched members for separably latching the first and second latched members, respectively.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A preferred embodiment of a snare drum 1 according to the present invention will now be described with reference to FIGS. 1 through 18. The snare drum 1 includes a snare wire unit.

Figure 1:
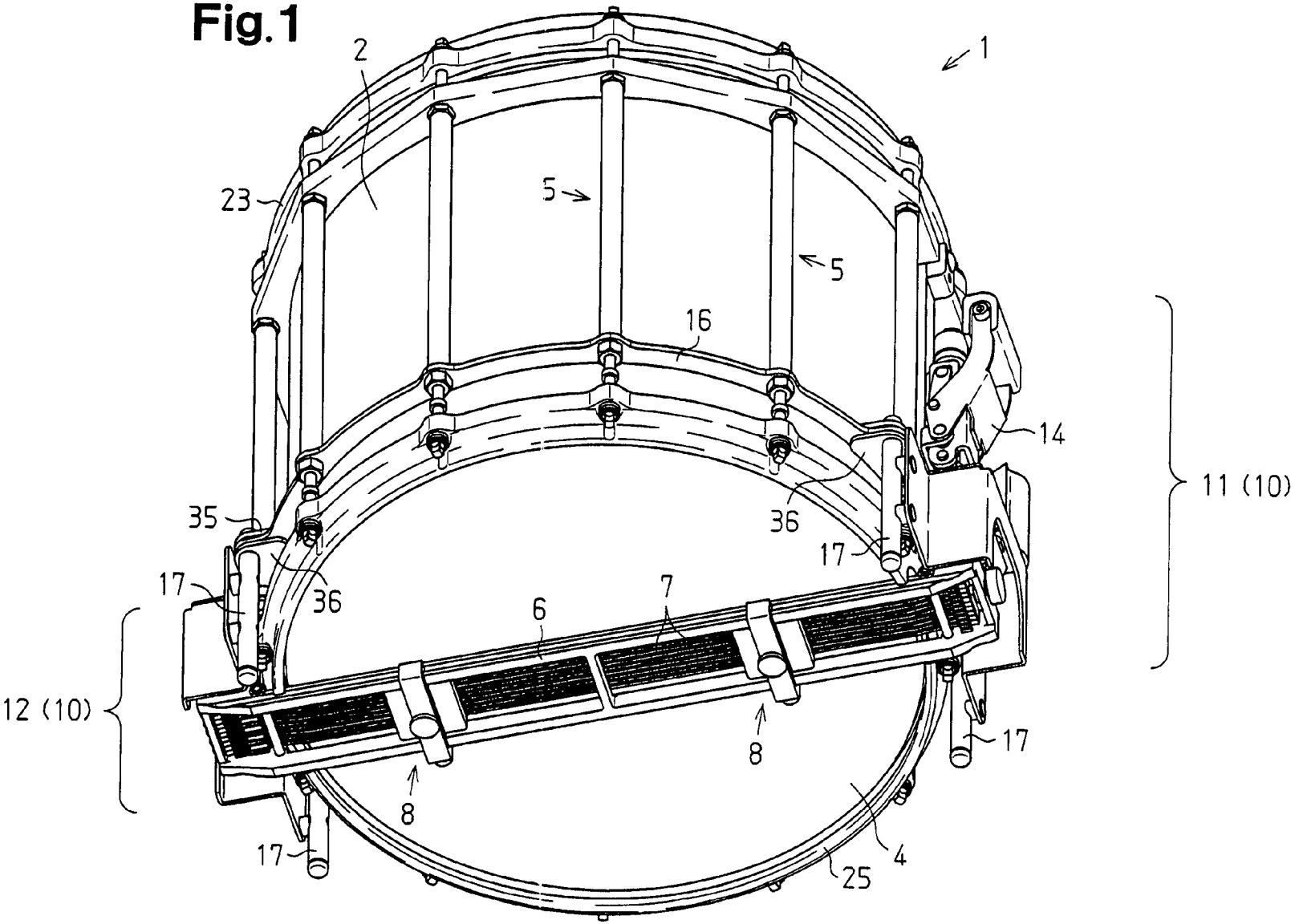
FIG. 1 is a lower perspective view showing a snare drum according to a preferred embodiment of the present invention.
Figure 2:
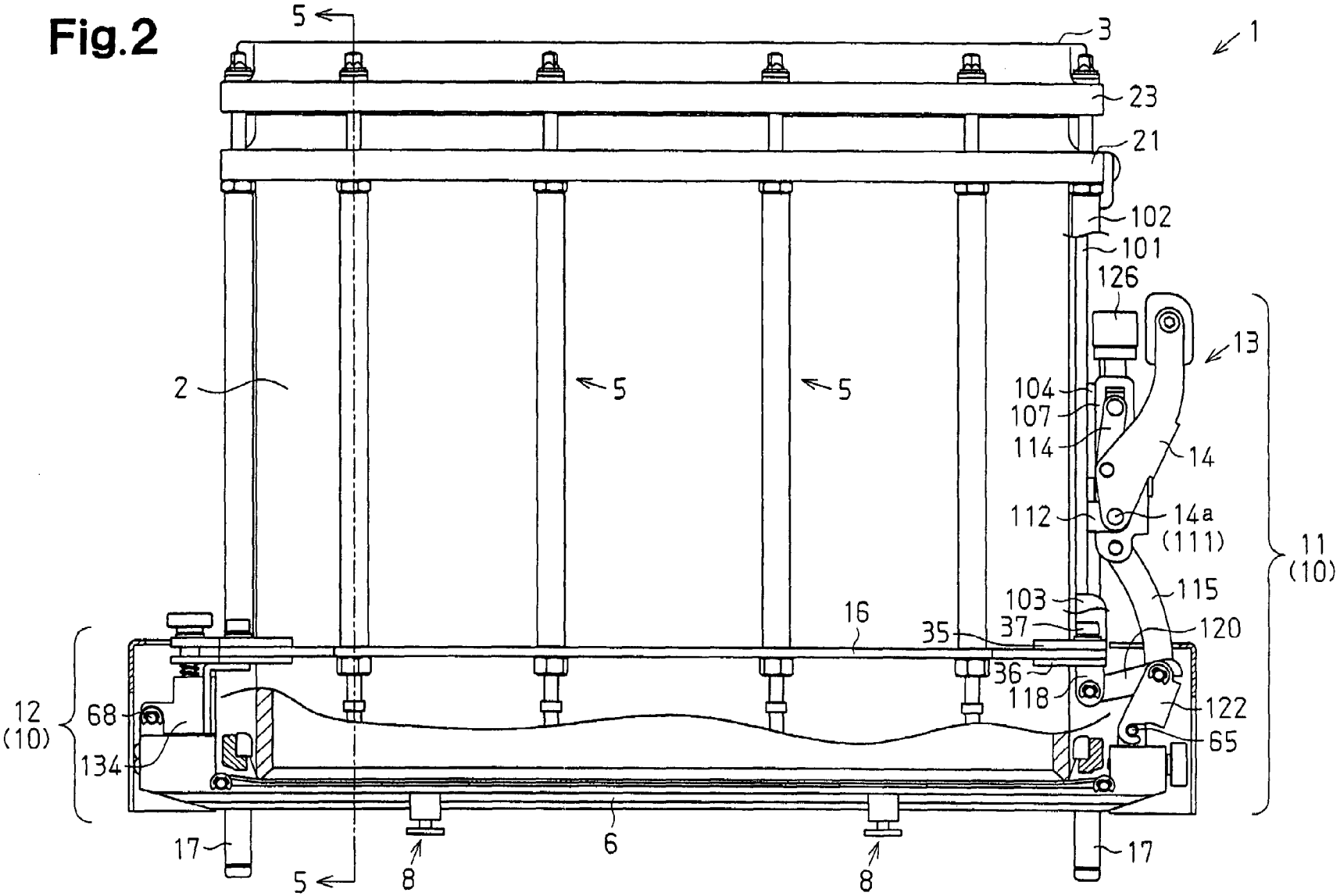
FIG. 2 is a front view showing the snare drum.

As shown in FIGS. 1 and 2, a snare drum 1 (hereafter, simply referred to as "drum") has a cylindrical drum shell 2, the upper and lower ends of which are open. The open upper and lower ends of the drum shell 2 are closed by disk-like upper head 3 (see FIG. 2) and a disk-like lower head 4 that are fixed to the drum shell 2 by an upper hoop 23 and a lower hoop 25, respectively. A plurality of (twelve in this embodiment) head adjusters 5 for adjusting the tension applied to the upper and lower heads 3 and 4 are arranged at equal angular intervals along the peripheral wall of the drum shell 2 so as to connect the upper hoop 23 and the lower hoop 25.

Figure 3:
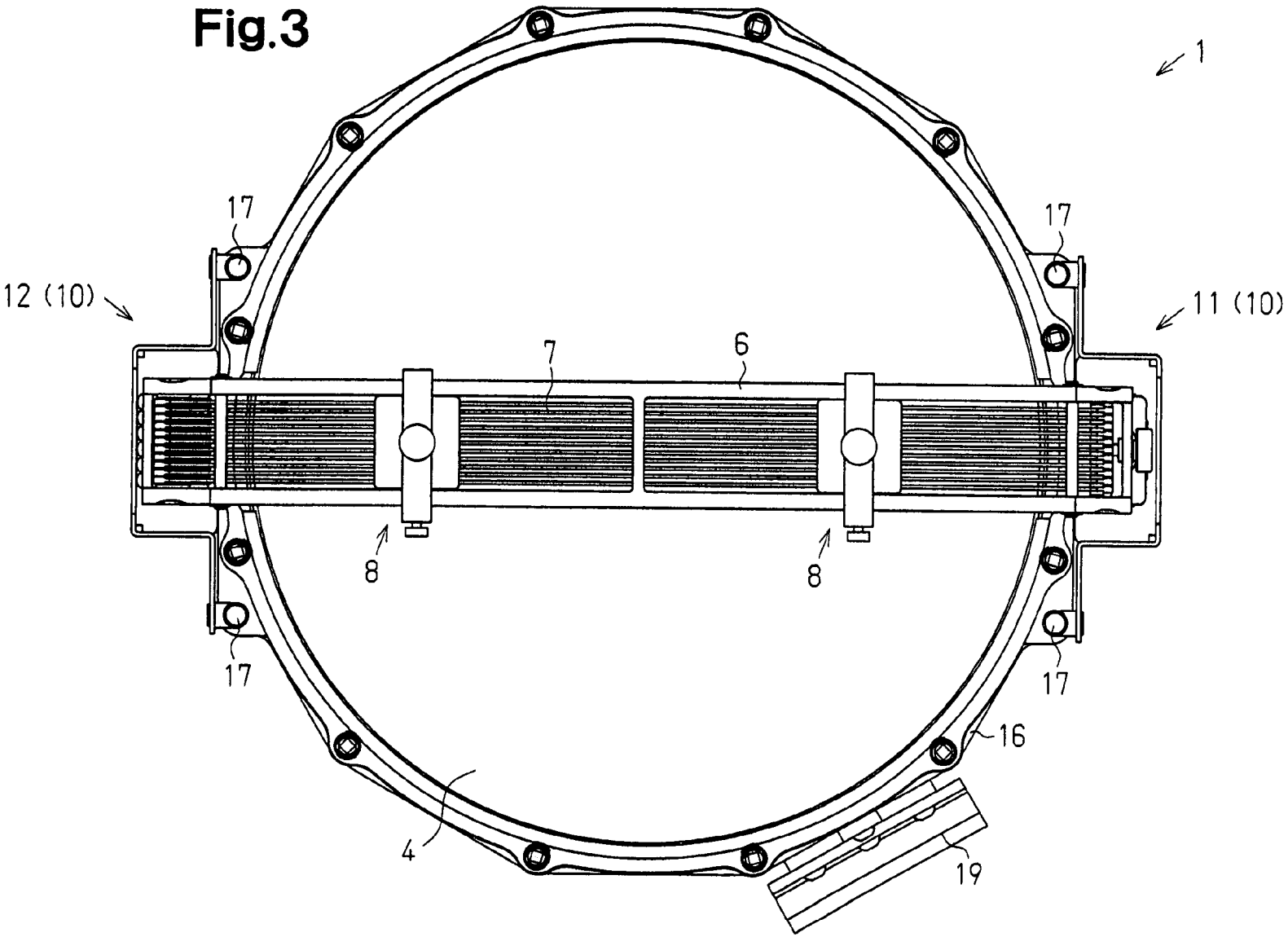
FIG. 3 is a bottom view showing the snare drum.

A plurality of snare wires 7, which are formed from stringing, are held by a snare wire unit frame 6 and are arranged on the lower head 4 to extend diametrically across the lower head 4. Additionally, as shown in FIGS. 1 and 3, dampers 8 are arranged at opposite sides of the frame 6 to adjust resonance when playing the drum 1 with the snare wires 7.

Further, as shown in FIG. 2, an attachment mechanism 10 is secured to the peripheral wall of the drum shell 2 so that the frame 6 can be attached to and detached from the drum shell 2. The attachment mechanism 10 includes an operating mechanism 11 (on the right side in FIG. 2) and a fixing mechanism 12 (on the left side in FIG. 2). The operating mechanism 11 and the fixing mechanism 12 are arranged at two positions located at opposite sides of the drum 1, or spaced by 180 degrees from each other with respect to the center of lower head 4. The operating mechanism 11 has a switching device 13 for switching the frame 6 between an engagement state in which the snare wires 7 are in contact with the lower head 4 and a disengagement state in which the snare wires 7 are separated from the lower head 4. The switching device 13 is operated by a pivotal operation lever 14.

A lower ring member 16 extends around the lower part of the drum shell 2 in a state slightly spaced from the peripheral wall of the shell 2. Four legs 17 are arranged along the lower ring member 16 in a symmetric manner (see FIG. 3).

Figure 4:
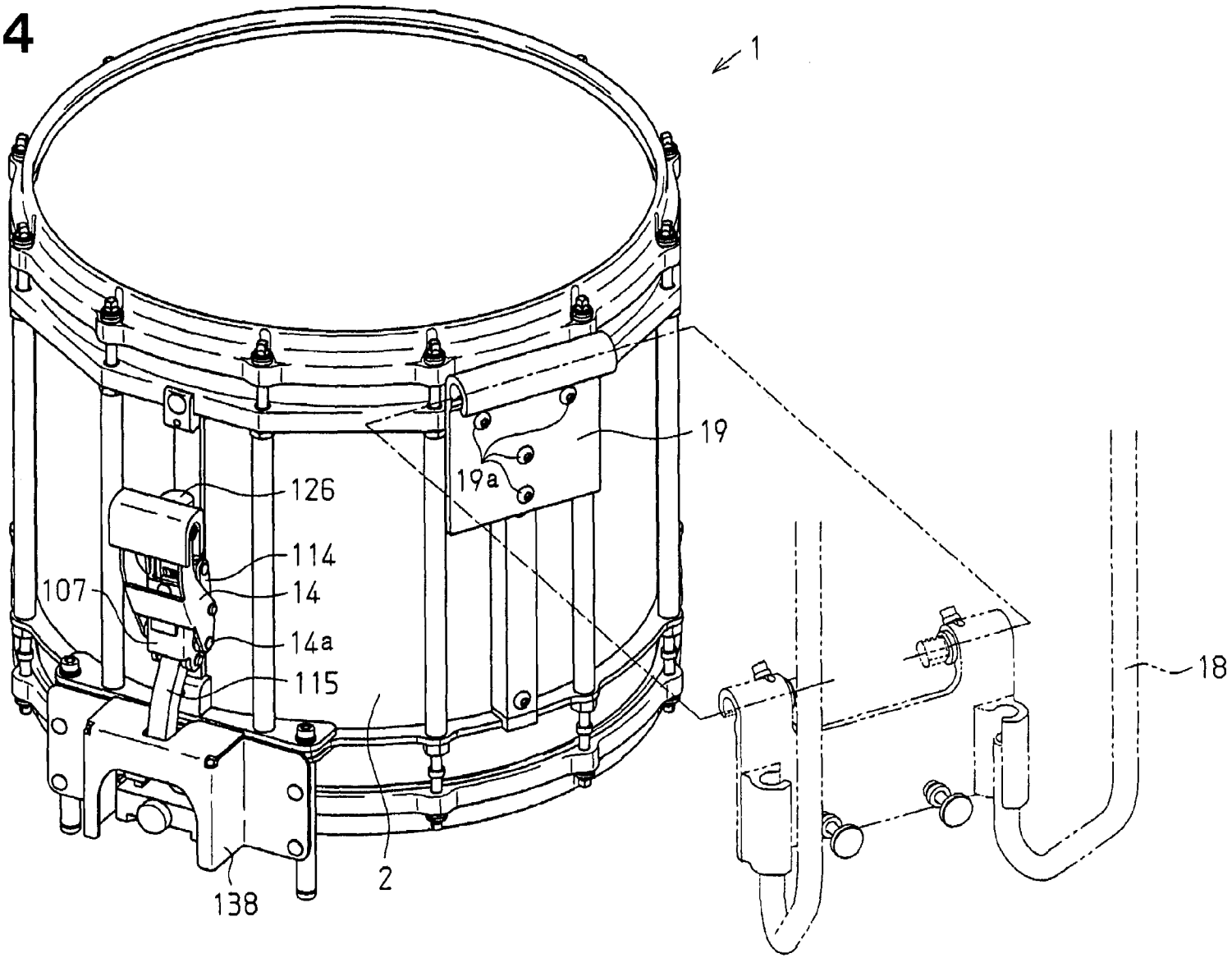
FIG. 4 is a rear perspective view showing the snare drum.

As shown in FIG. 4, when the snare drum 1 is used as a marching snare drum, a carrier attachment component 19 is fastened to the rear of the drum shell 2 by a plurality of screws 19*a* so that a carrier 18 can be attached to the carrier attachment component 19.

The head adjusters 5, the frame 6, the damper 8, and the frame attachment mechanism 10 will now be described one by one in detail.

(Head Adjuster 5)

Figure 5:
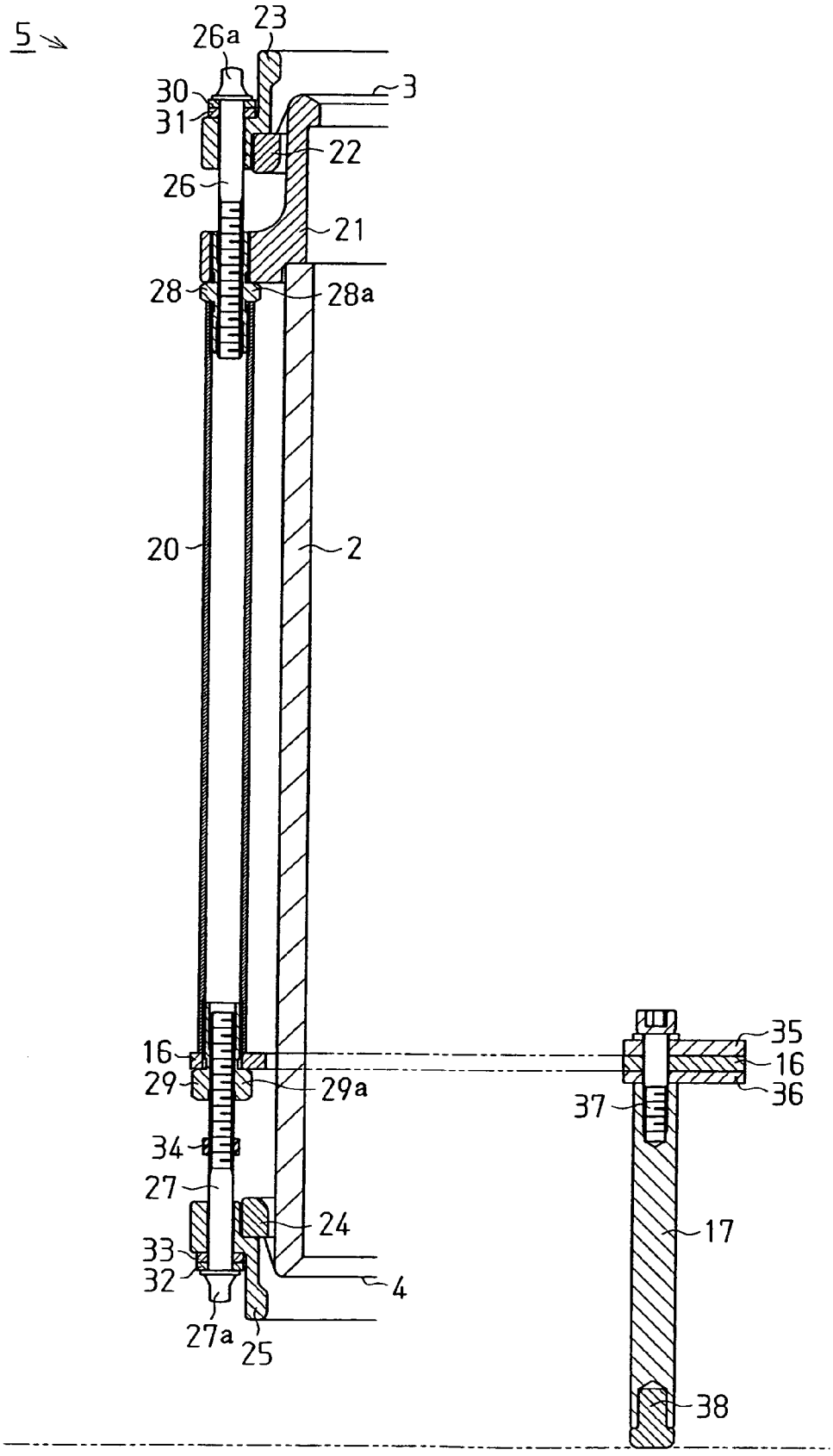
FIG. 5 is an enlarged cross-sectional view taken along line 5—5 in FIG. 2 and mainly shows a head adjuster.

FIG. 5 shows a state in which the drum 1 of the present embodiment is placed on a flat surface such as a floor. As shown in FIG. 5, an annular reinforcing ring (upper ring member) 21 is arranged at the upper part of the drum shell 2 to be fitted to the peripheral wall of the drum shell 2. An annular upper head frame 22 is fitted to the peripheral wall of the drum shell 2 on the outer side of the reinforcing ring 21. The upper head frame 22 holds the periphery of the upper head 3. An annular upper hoop 23 fitted to the peripheral wall of the drum shell 2 is arranged on the outer side of the upper head frame 22. In the same manner, the periphery of the lower head 4 is held by an annular lower head frame 24 fitted to the peripheral wall of the drum shell 2. An annular lower hoop 25 is fitted to the peripheral wall of the drum shell 2 on the outer side of the lower head frame 24.

Each head adjuster 5 includes a hollow cylindrical tension pipe 20, an upper tension bolt 26 for connecting the tension pipe 20 with the upper hoop 23, and a lower tension bolt 27 for connecting the tension pipe 20 with the lower hoop 25. The tension pipe 20 is located between the reinforcing ring 21 and the ring member 16.

The tension pipe 20 and the upper tension bolt 26 are coupled together by an upper tension nut 28. The tension pipe 20 and the lower tension bolt 27 are coupled together by a lower tension nut 29. The upper tension nut 28 is inserted into the upper part of the tension pipe 20 and engaged with the upper tension bolt 26 which is inserted into the tension pipe 20 from above the upper tension nut 28. The lower tension nut 29 is inserted into the lower part of the tension pipe 20 and engaged with the lower tension bolt 27 which is inserted into the tension pipe 20 from below the lower tension nut 29. The upper surface of the body 28*a* of the upper tension nut 28 contacts the lower surface of the reinforcing ring 21. The upper surface of the body 29*a* of the lower tension nut 29 contacts the lower surface of the ring member 16.

A metal washer 30 and a brass washer 31 are arranged between the upper hoop 23 and a bolt head 26*a*, which serves as a rotary operating member of the upper tension bolt 26. In the same manner, a metal washer 32 and a brass washer 33 are arranged between the lower hoop 25 and a bolt head 27*a*, which serves as a rotary operating member of the lower tension bolt 27. Further, a rubber stopper 34 is arranged on a substantially intermediate part of the lower tension bolt 27 between the lower tension nut 29 and the lower hoop 25 to prevent the lower tension bolt 27 from falling off.

As shown in FIG. 5, an upper plate 35 is arranged on the top of the ring member 16 and a lower plate 36 is arranged on the bottom of the ring member 16. Each leg 17 projects downward from the lower plate 36. The upper plate 35, the ring member 16, the lower plate 36, and the legs 17 are fastened together by a plurality of screws 37 inserted from above the upper plate 35 so that the legs 17 extend vertical relative to the floor. A resin cap 38 is attached to the lower end of each leg 17.

(Frame 6)

Figure 9:
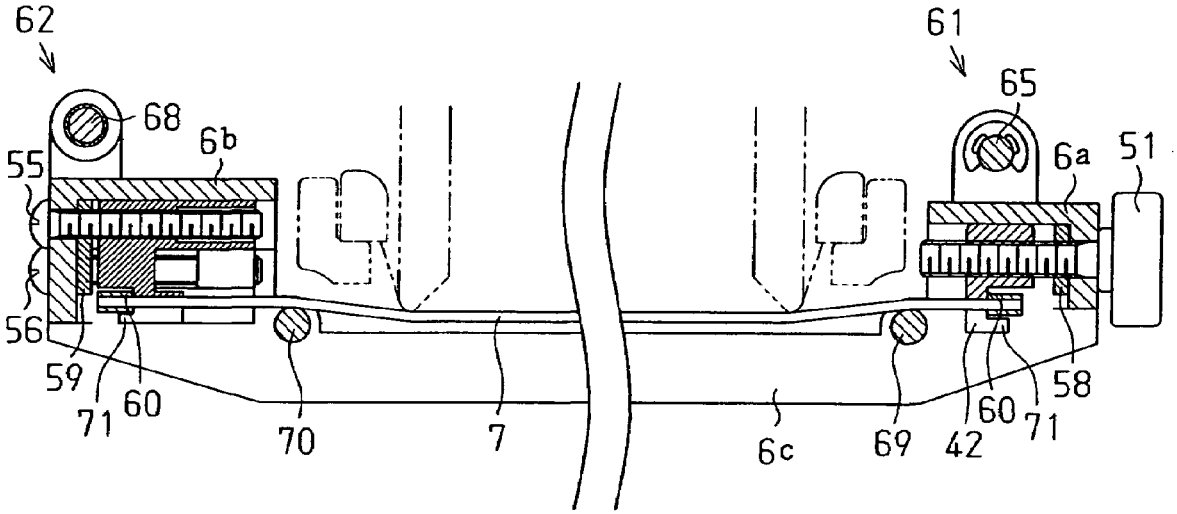
FIG. 9 is a cross-sectional side view of the frame.
Figure 10:
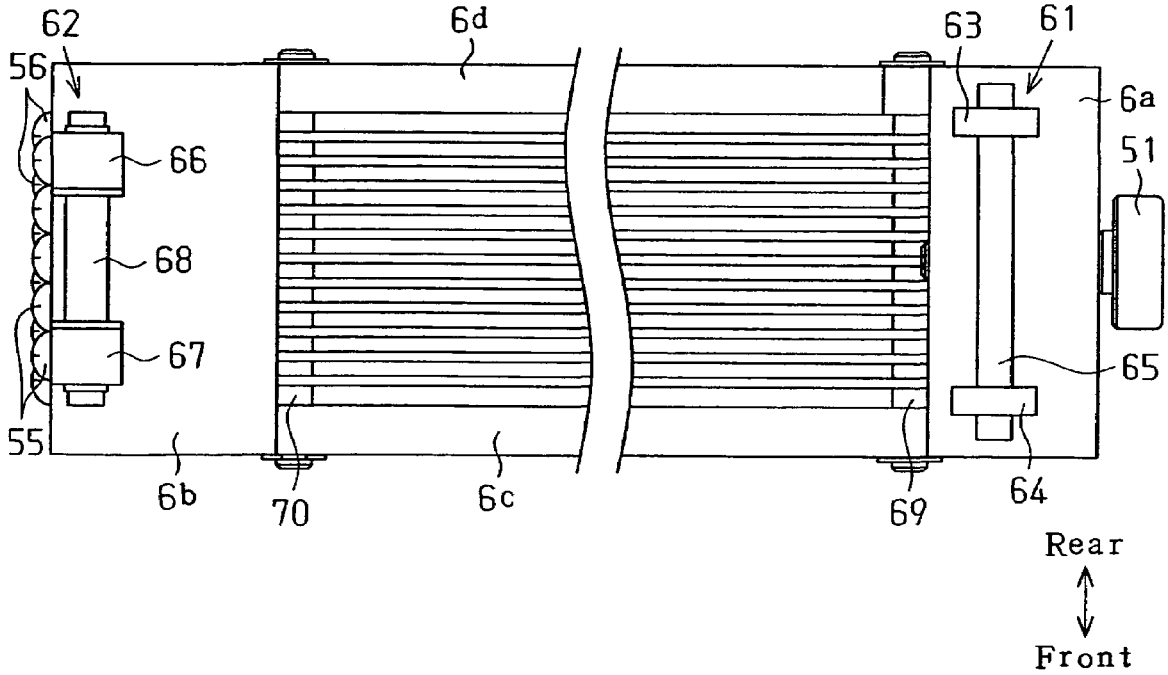
FIG. 10 is a plan view showing the frame.

The frame 6 will be now described in more detail. The frame 6 has the shape of a rectangular circuit, as shown in FIGS. 3, 9, and 10. The frame 6 has a right side portion 6*a*, a left side portion 6*b*, a front side portion 6*c*, and a rear side portion 6*d*. The snare wires 7 are held in the region surrounded by these side portions. The opposite ends of the frame 6 extend diagonally from an upper outer edge to a lower inner edge.

Figure 6:
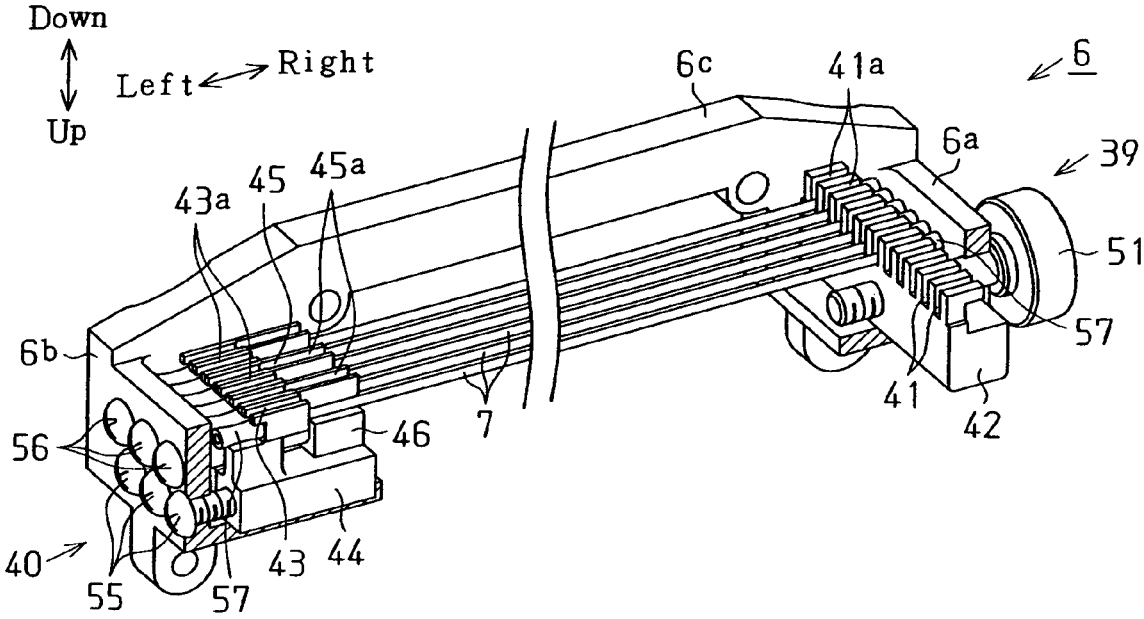
FIG. 6 is a perspective view showing a frame.

FIG. 6 is a perspective view showing the frame 6 in a reversed state. Therefore, four directions (up, down, right, and left) of the frame 6 are as indicated in the drawing. The same applies to FIGS. 7 and 8. As shown in FIG. 6, a collective adjustment mechanism 39 is arranged at the right end of the frame 6 for collectively adjusting the tension applied to the snare wires 7. An individual adjustment mechanism 40 for adjusting the tension applied to individual snare wires 7 is arranged at the left end of the frame 6.

The collective adjustment mechanism 39 includes a collective adjustment piece 42, having a lower portion provided with a plurality of parallel fitting grooves 41, and a collective adjustment bolt 51. The collective adjustment bolt 51, which collectively adjusts the tension applied to the snare wires 7, extends through a middle portion of the collective adjustment piece 42. A rubber bolt tightening member 58 (see FIG. 9) is mounted on the bolt 51.

The individual adjustment mechanism 40 is provided with a plurality of (five in the present embodiment) first individual adjustment pieces 44 each having a fitting groove 43, a plurality of (six in the present embodiment) second individual adjustment pieces 46 each having a fitting groove 45, and screws 55 and screws 56 respectively associated with the first and second individual adjustment pieces 44 and 46. The screws 55 and 56, which serve as an operating means, adjust the tension applied to each of the snare wires 7 and respectively extend through the first and second individual adjustment pieces 44 and 46. A rubber screw tightening member 59 is mounted on each of the screws 55 and 56 (see FIG. 9). The fitting grooves 41, 43, and 45 respectively have openings 41*a*, 43*a*, and 45*a* extending downwards.

Figure 7:
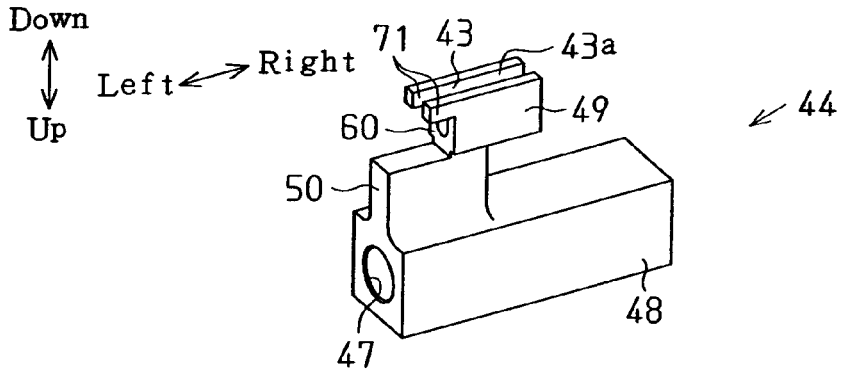
FIG. 7 is perspective view showing a first individual adjustment piece for a snare wire.

As shown in FIG. 7, each first individual adjustment piece 44 includes a rectangular parallelepiped first base 48 through which a screw hole 47 extends. A groove formation portion 49, which is defined on the bottom of the base 48, includes the fitting groove 43, which is U-shaped. An extension 50 extends downward from the vicinity of the left end of the first base 48. The groove formation portion 49 is located near the right end of the extension 50.

Figure 8:
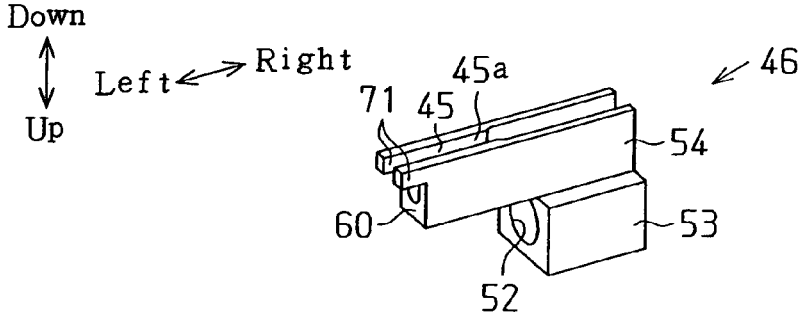
FIG. 8 is a perspective view showing a second individual adjustment piece for a snare wire.

As shown in FIG. 8, each second individual adjustment piece 46 includes a rectangular parallelepiped second base 53 through which a screw hole 52 extends. A groove formation portion 54, which is defined on the bottom of the second base 53, includes the fitting groove 45, which is U-shaped. In contrast with the first individual adjustment piece 44, the second individual adjustment piece 46 has no extension 50 provided on the second base 53, and the second base 53 is smaller in size than the first base 48. When the first and second individual adjustment pieces 44 and 46 are attached to the frame 6, the second base 53 is arranged adjacent to the extension 50 of the first base 48 so that the fitting groove 43 of the first individual adjustment piece 44 is flush with and adjacent to the fitting groove 45 of the second individual adjustment piece 46 (see FIG. 6). The fitting grooves 43 and the fitting grooves 45 are arranged alternately. In the present embodiment, a total of eleven parallel fitting grooves are arranged between the front and rear sides of the frame 6 in the same manner as the adjustment piece 42.

A screw 55 (see FIG. 6), which functions as an operating member for adjusting the tension applied to the associated snare wire 7, is inserted in the screw hole 47 of the first individual adjustment piece 44 shown in FIG. 7. In the same manner, a screw 56, which functions as an operating member for adjusting the tension applied to the associated snare wire 7, is inserted in the screw hole 52 of the second individual adjustment piece 46 shown in FIG. 8.

Referring to FIG. 6, the ends of each snare wire 7 are press-fitted in a cylindrical metal sleeve 57. The right end of the snare wire 7 is fitted in the associated fitting groove 41 of the adjustment piece 42, while the left end of the snare wire 7 is fitted in the fitting groove 43 of the associated first individual adjustment piece 44 or the fitting groove 45 of the associated second individual adjustment piece 46. Consequently, each snare wire 7 is held on the frame 6 by two cylindrical metal sleeves 57.

The cylindrical metal sleeves 57 abut against abutment portions 60 defined in the associated fitting grooves 41, 43, or 45 (see FIG. 9) and are held by projections 71 formed at the ends of the groove formation portions 49 and 54 (i.e., the left ends in FIGS. 7 and 8). This prevents the snare wires 7 from falling down. In the present invention, the abutment portions 60 correspond to lock portions. Further, the collective adjustment piece 42, the first individual adjustment piece 44, and the second individual adjustment piece 46 correspond to snare wire supports.

As shown in FIG. 9, the collective adjustment bolt 51 is fastened to the collective adjustment piece 42 in a state in which rotation of the collective adjustment piece 42 is restricted due to the engagement between the collective adjustment piece 42 and the frame 6. Accordingly, if the collective adjustment bolt 51 is turned clockwise, the collective adjustment piece 42 moves rightward relative to the frame 6. As a result, force is applied in a rightward direction (in a radially outward direction of the drum shell 2) to all the snare wires 7 fixed to the collective adjustment piece 42. This increases the tension applied to the snare wires 7. If the collective adjustment bolt 51 is turned counterclockwise, the tension applied to all the snare wires 7 decreases due to actions that occur in an opposite manner of the above-mentioned actions.

Further, the screws 55 are fastened to the associated first individual adjustment pieces 44 in a state in which rotation of the first individual adjustment pieces 44 is restricted due to the engagement between the first individual adjustment pieces 44 and the frame 6. Accordingly, in the same manner as the collective adjustment bolt 51, if any of the screws 55 is turned clockwise, the associated first individual adjustment piece 44 is moved leftward relative to the frame 6. As a result, forced is applied in a leftward direction (in a radially outward direction of the drum shell 2) to the single snare wire 7 fixed to the first individual adjustment piece 44. This increases the tension applied to the snare wire 7. If the screw 55 is turned counterclockwise, the tension applied to the snare wire 7 is decreased due to actions that occur in an opposite manner of the above-mentioned actions. The actions of the screws 56 and the second individual adjustment pieces 46 occur in the same manner and will thus not be described in detail.

Further, the snare wires 7 may easily be removed from the frame 6 by loosening the associated screws 55 and 56 in the individual adjustment mechanism 40. In this state, the cylindrical metal sleeves 57 at the opposite ends of the snare wires 7 are pulled out and separated from the abutment portions 60. Then, the snare wires 7 are lifted out of the openings 41*a*, 43*a*, and 45*a* of the fitting grooves 41, 43, and 45 and removed from the frame 6.

As shown in FIG. 10, a first engaged portion 61 is provided at the right end of the frame 6 facing towards the frame attachment mechanism 10 (see FIG. 2), and a second engaged portion 62 is provided at the left end of the frame 6. Bearings 63 and 64 are provided at the front and rear sides of the first engaged portion 61. The bearings 63 and 64 support a first connection shaft 65, which serves as a latched member. Bearings 66 and 67 are provided at the front and rear sides of the second engaged portion 62. The bearings 66 and 67 support a second connection shaft 68 (locking shaft), which serves as a latched member.

Figure 11:
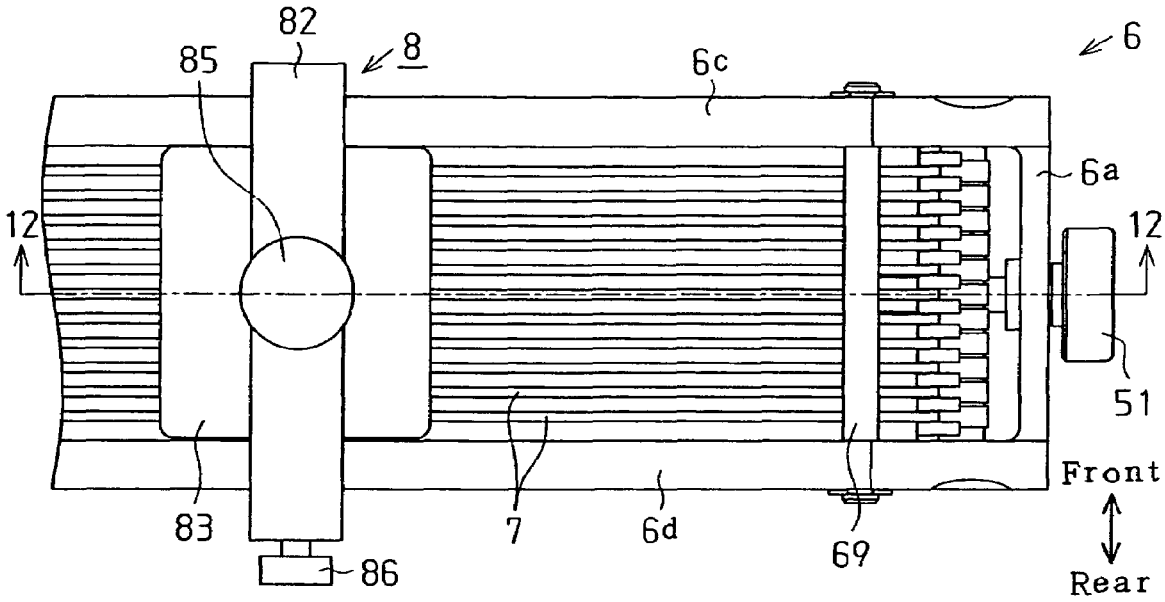
FIG. 11 is a bottom view showing the frame.
Figure 12:
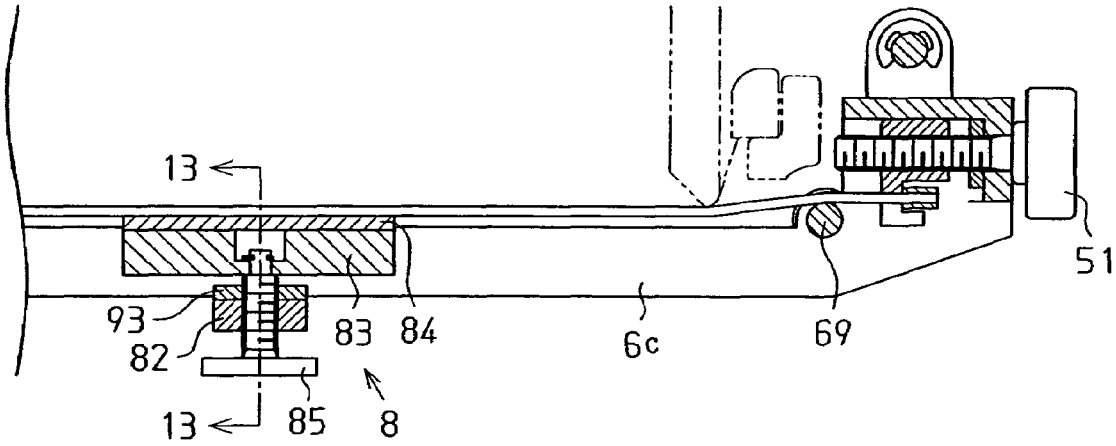
FIG. 12 is a cross-sectional view taken along line 12—12 in FIG. 11 and shows a damper.

As shown in FIGS. 9 through 11, a right pressing shaft 69 is provided in the right side portion 6*a* of the frame 6. In the same manner, a left pressing shaft 70 is provided in the left side portion 6*b* of the frame 6. The right and left pressing shafts 69 and 70 extend orthogonally to the snare wires 7 and extend through the front and rear side portions 6*c* and 6*d*. As shown in FIG. 9, the right and left pressing shafts 69 and 70 function as adjustment members for adjusting the heights of the snare wires 7 such that the snare wires 7 uniformly abut against the lower head 4.

(Damper 8)

Figure 13:
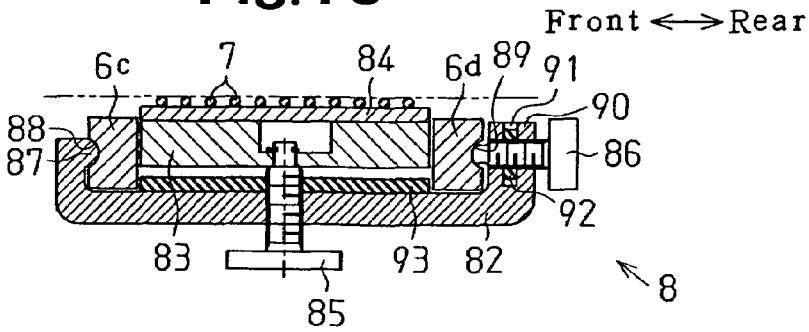
FIG. 13 is a cross-sectional view taken along line 13—13 in FIG. 12 and shows the damper.

As shown in FIG. 13, each damper 8 includes a slide member 82 which bridges between the front side portion 6*c* and rear side portion 6*d* of the frame 6. The damper 8 further includes a thin rectangular parallelepiped damping plate 83, a felt pad 84, a lower operating screw 85, and a rear operating screw 86. The slide member 82 includes a projection 87 having a substantially U-shaped cross-section and formed on the front inner wall. The projection 87 is engaged with a groove 88 formed in the front side portion 6*c* of the frame 6. The slide member 82 has a rear side portion 90 with an inner surface slightly spaced from the rear side portion 6*d* of the frame 6. The rear operating screw 86 is inserted in the slide member 82 from the rear side so that the front end of the rear operating screw 86 abuts against a groove 89 formed in the rear side portion 6*d* of the frame 6. This fixes the damper 8 to the frame 6. Further, a hole 91 is formed in the top of the rear side portion 90 of the slide member 82. A rubber tightening member 92 is provided in the hole 91 to prevent the loosening of the rear operating screw 86.

The rear operating screw 86 is tightened so that the front end of the rear operating screw 86 comes into contact with the frame 6 and is loosened to separate the front end of the rear operating screw 86 from the frame 6. When the front end of the screw 86 is separated from the frame 6, sliding of the damper 8 in the longitudinal direction of the frame 6 is enabled.

The pad 84 is bonded to the damping plate 83. The damping plate 83 is integrated with the slide member 82 by the lower operating screw 85, which extends through the slide member 82 and plate 83. Further, a rubber tightening member 93 is fixed to the lower surface of the slide member 82 to prevent loosening of the lower operating screw 85.

The lower operating screw 85 is tightened and loosened to vertically move the sound reduction plate 83 so that the pad 84 contacts or moves away from the snare wires 7. The pad 84 contacts the snare wires 7 to suppress resonance of the snare wires 7 and mute the noise of the snare wires 7.

(Frame Attachment Mechanism 10)

The operating mechanism 11 and the fixing mechanism 12 of the frame attachment mechanism 10 will now be described.

The operating mechanism 11 shown in FIG. 2 is connected to the first engaged portion 61 of the frame 6 that includes the first connection shaft 65 to attach the frame 6 to the drum shell 2. A base plate 101 separates the operating mechanism 11 from the drum shell 2 by a predetermined distance. A fixing member 102 fixing the upper part of the base plate 101 is fixed to the reinforcing ring 21 with a screw (not shown). In the same manner, a fixing member 103 fixes the lower part of the base plate 101 to the ring member 16 with a screw (not shown).

Figure 14:
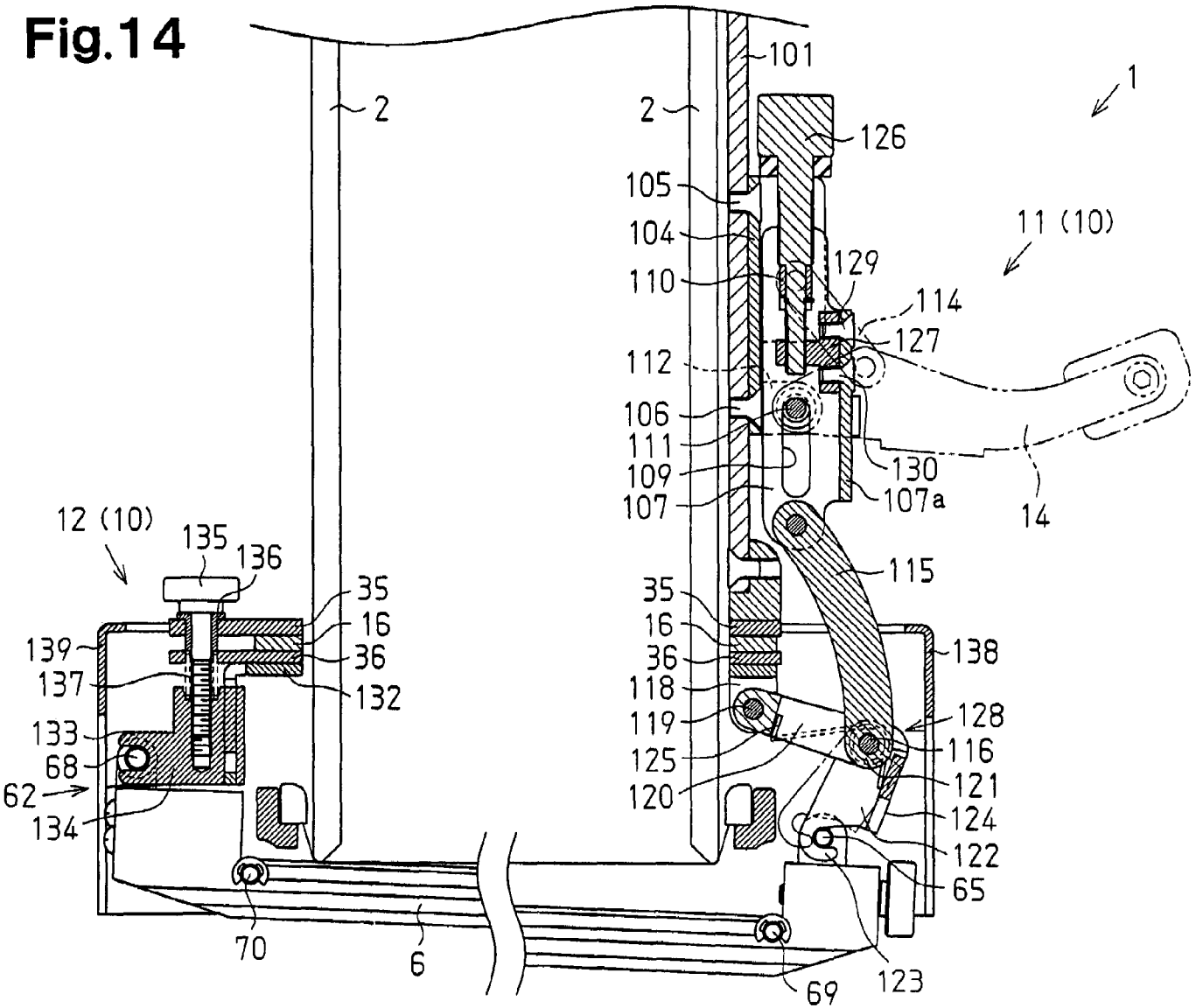
FIG. 14 is a cross-sectional view showing a frame attachment mechanism in a state in which an operation lever is located at the lowermost position.
Figure 15:
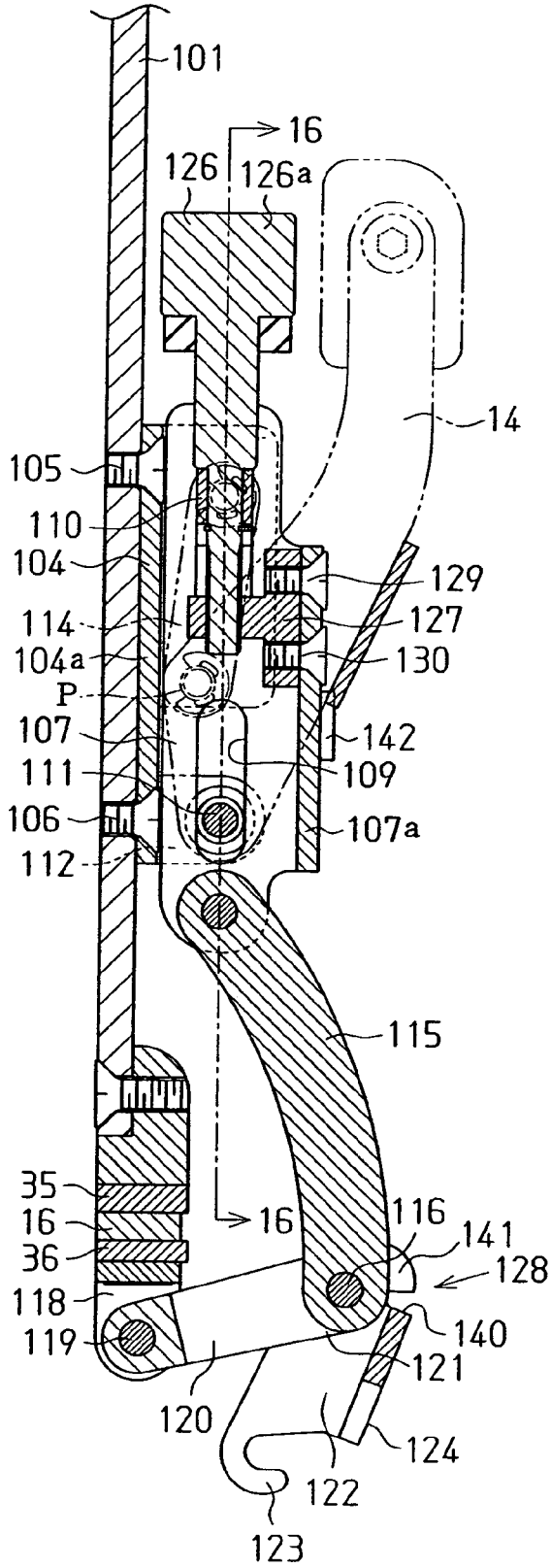
FIG. 15 is a cross-sectional view showing a frame attachment mechanism in a state in which the operation lever is located at the uppermost position.

FIG. 14 shows the operation lever 14 in a state in which the operation lever 14 is located at the lowermost position of its pivotal range. FIG. 15 shows the operation lever 14 in a state in which the operation lever 14 is located at the uppermost portion of its pivotal range. As shown in FIGS. 14 and 15, a bracket 104 having a U-shaped plane cross-section is fixed to the base plate 101 by means of two screws 105 and 106 with its attachment portion 1 04a in contact with the base plate 101.

A slide member 107 having a U-shaped plane cross-section covers the bracket 104. The slide member 107 has an intermediate portion 107*a* spaced from and facing towards the base plate 101. A rubber stopper 142 for the operation lever 14 (see FIG. 15) is attached to the intermediate portion 107*a* of the slide member 107.

Figure 16:
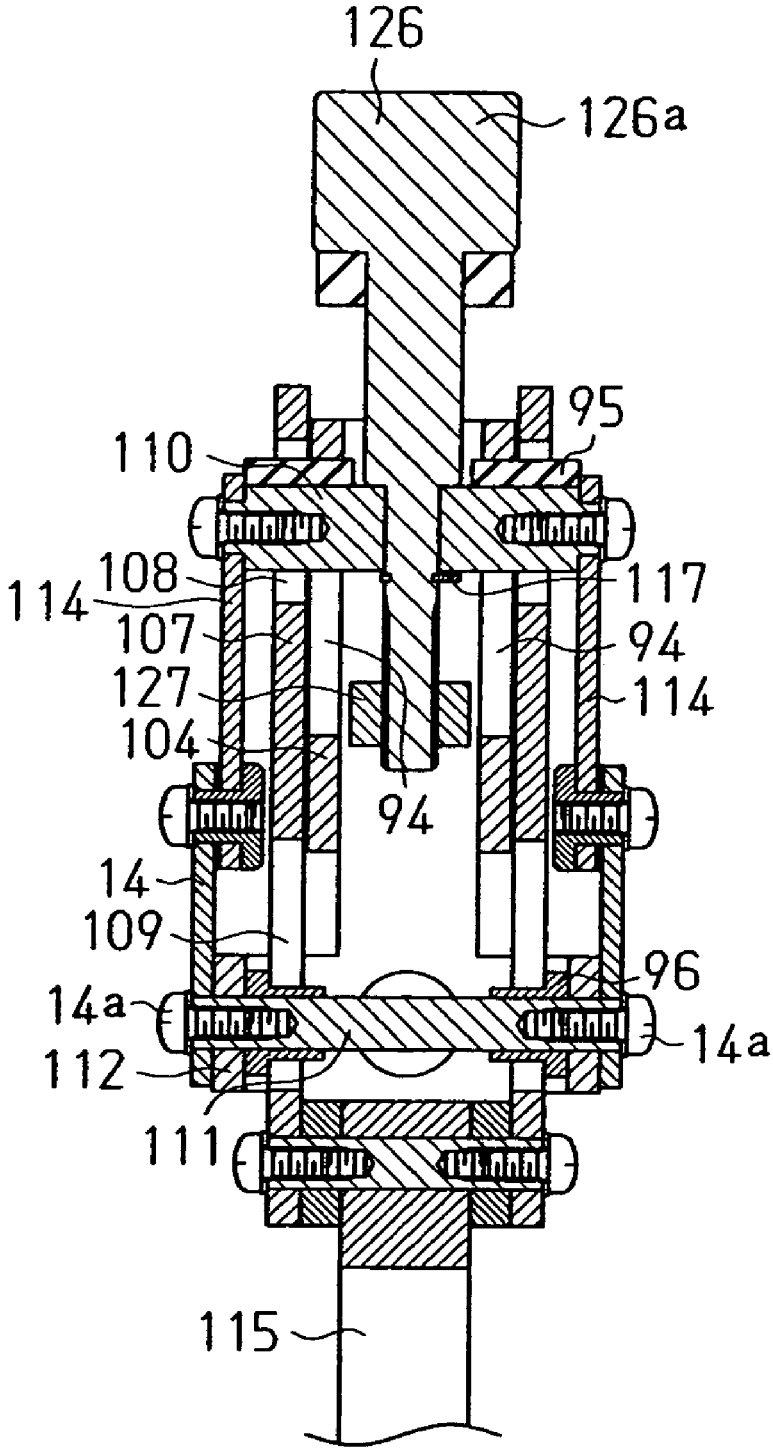
FIG. 16 is a partial cross-sectional view taken along line 16—16 in FIG. 15.
Figure 17:
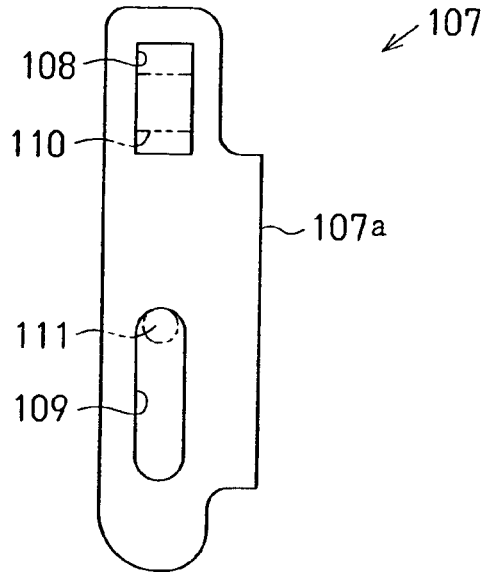
FIG. 17 is a front view showing a slide member.

As shown in FIG. 17, two elongated holes 108 and 109 extend through the upper part and the lower part of the two side walls of the slide member 107. As shown in FIG. 16, two elongated holes 94 extend through the upper part of the bracket 104 in the same manner. A coupling shaft 110 is inserted through the right and left elongated holes 108 of the slide member 107 and the right and left elongated holes 94 of the bracket 104. Each end of the coupling shaft 110 is coupled with an associated link 114 by a screw. The coupling shaft 110 has a substantially square cross-section (see FIG. 17) so that the coupling shaft 110 does not rotate relative to the elongated hole 94. Further, the links 114 are rotatable with respect to the coupling shaft 110. A rubber washer 95 is attached to the upper surface of the coupling shaft 110.

A support shaft 111 is inserted through the two elongated holes 109 of the slide member 107 to extend through a lower portion 112 of the bracket 104 at the outer side of the elongated holes 109. The basal end of the operation lever 14 is connected to opposite ends of the support shaft 111 by a pair of screws 14*a* so as to enable relative pivoting between the operation lever 14 and the support shaft 111. Two bushings 96 are attached to the support shaft 111. Each bushing 96 is in contact with the lower portion 112 of the bracket 104 and the wall of the associated elongated hole 109 of the slide member 107.

The lower ends of the two links 114 are pivotally coupled to the operation lever 14 at a position separated from the basal end of the operation lever 14 by a predetermined distance. As described above, the upper end of each link 114 is pivotally coupled to the coupling shaft 110. Accordingly, when the operation lever 14 is pivoted, the motion of the operation lever 14 is transferred to the coupling shaft 110 by the links 114. Thus, the coupling shaft 110 slides along the walls of the elongated holes 94 in the bracket 104. As the coupling shaft 110 slides, the slide member 107, which is connected to the coupling shaft 110 by a fine adjustment bolt 126, slides vertically within a range corresponding to the length of the elongated holes 109 and independently from the bracket 104 with the support shaft 111 functioning as a guide.

Additionally, the upper end of a curved arm 115 is pivotally coupled to the lower end of the slide member 107. An operation shaft 116 is inserted through the lower end of the arm 115 with the two ends of the operation shaft 116 projecting out of the arm 115.

As shown in FIG. 15, a mounting portion 118 having a shaft hole is defined on the lower surface of the lower plate 36 so as to extend downwards. A shaft 119 is inserted through the shaft hole. The basal end of a coupling arm 120 is pivotally coupled to the shaft 119. The coupling arm 120 has a bifurcated distal end 121. The distal end 121 of the coupling arm 120 supports the lower end of the arm 115 from opposite sides. In this state, the coupling arm 120 is pivotally connected to the arm 115 by the operation shaft 116.

Figure 18:
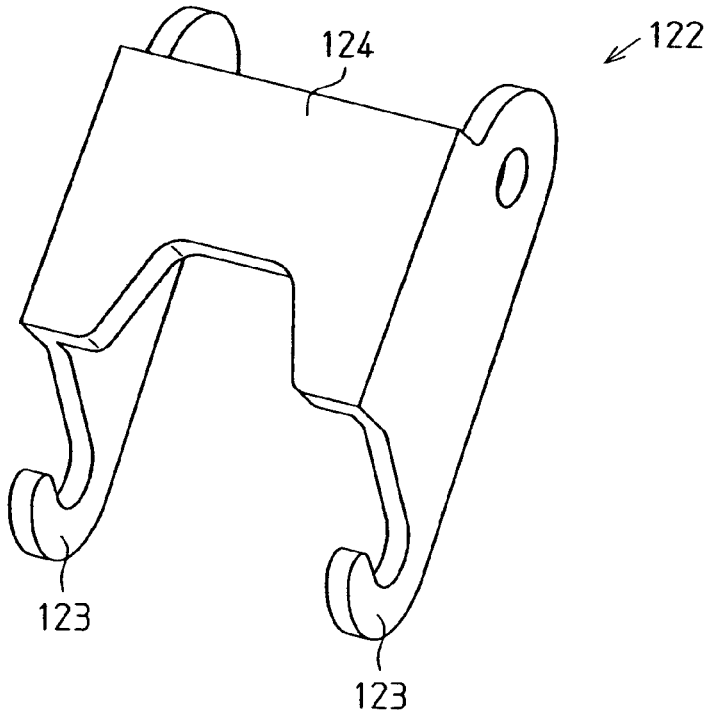
FIG. 18 is a perspective view showing a latching member.
Figure 19:
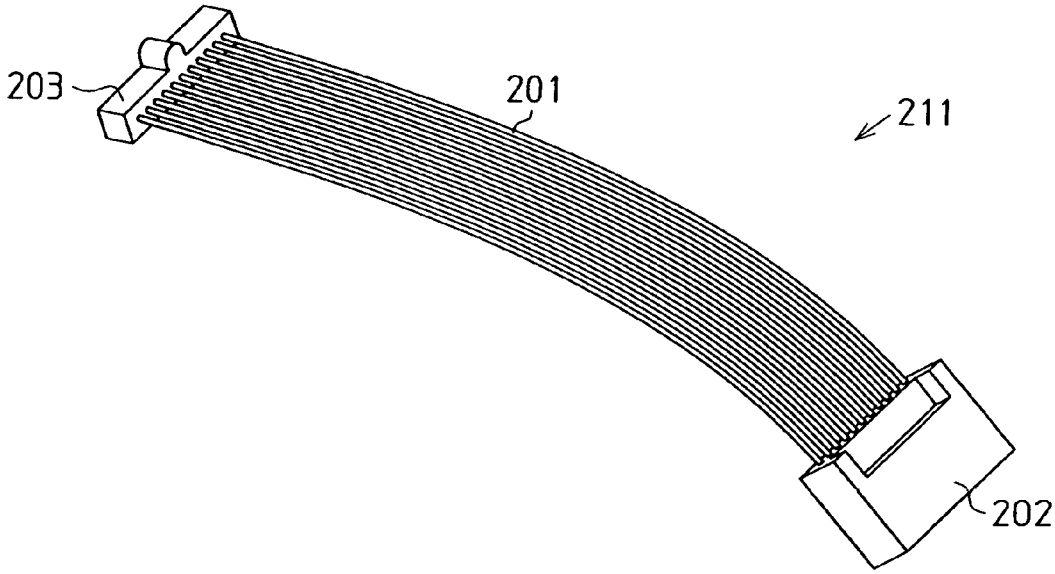
Fig.19 (Prior Art)
FIG. 19 is a perspective view showing a snare wire unit according to a first prior art example.
Figure 20:
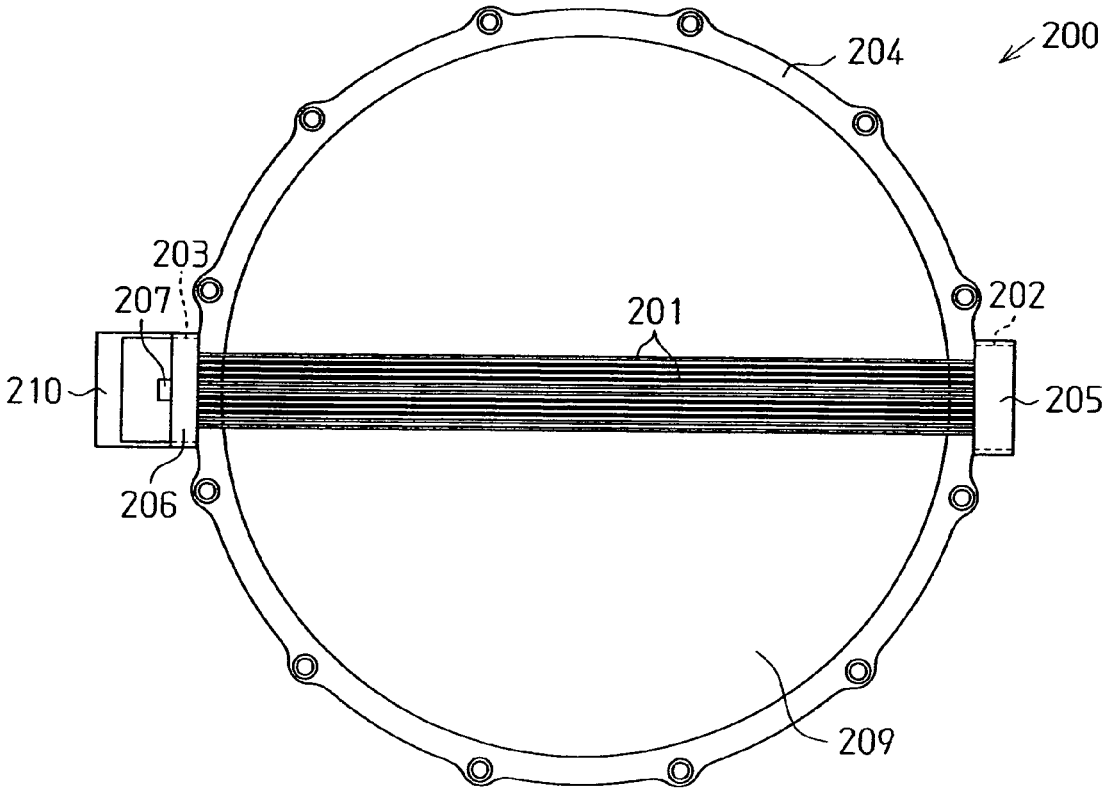
Fig.20 (Prior Art)
FIG. 20 is a bottom view showing the snare drum of the first prior art example.

The upper end of a latching member 122 having a hook-shaped distal end 123 is pivotally connected to the operation shaft 116. As shown in FIGS. 14 and 18, the distal end 123 is hooked to the first connection shaft 65 of the frame 6. Further, an operating portion 124 is provided on a side of the latching member 122 to manipulate the latching member 122 with a finger.

A spring 125 is wound around the operation shaft 116 with one end being hooked to the coupling arm 120 and the other end hooked to the latching member 122. Thus, the spring 125 urges the latching member 122 to pivot counterclockwise as viewed in FIG. 14 in a radially outward direction of the drum shell 2. As shown in FIG. 15, the latching member 122 has a notch 140, which abuts against a stopper 141 projecting from the distal end 121 of the coupling arm 120 to restrict further counterclockwise pivoting of the latching member 122. The latching member 122 having the operating portion 124, the operation shaft 116, and the spring 125 form an engagement portion 128.

The fine adjustment bolt 126 of the operating mechanism 11 finely adjusts the position of the frame 6 when the snare wires 7 are in contact with the lower head 4. The fine adjustment bolt 126 has a head 126*a* located above the bracket 104. More specifically, a support member 127 is fixed by two screws 129 and 130 in the slide member 107, which extends along the outer wall of the drum shell 2. The fine adjustment bolt 126 extends through the support member 127 and the coupling shaft 110. The fine adjustment bolt 126 is provided with a snap ring 117 engaging the lower portion of the coupling shaft 110. The coupling shaft 110 is coupled to the bolt 126 in a state in which the coupling shaft 110 is held between the snap ring 117 and a stepped portion of the fine adjustment bolt 126. Accordingly, the fine adjustment bolt 126 is rotatably inserted through the coupling shaft 110 and fastened with the support member 127. The height of the fine adjustment bolt 126 and the coupling shaft 110 relative to the support member 127, that is, the distance between the coupling shaft 110 and the support member 127 is adjusted by rotating the fine adjustment bolt 126. This adjusts the height of the slide member 107 relative to the coupling shaft 110. For example, if the fine adjustment bolt 126 is rotated clockwise to decrease the distance between the coupling shaft 110 and the support member 127, the slide member 107 is lifted by a distance corresponding to the number of rotations of the fine adjustment bolt 126. Consequently, the latching member 122 is also lifted to raise the frame 6.

In this state, the relative position between the coupling shaft 110 and the slide member 107 changes. As shown in FIG. 17, however, since margins are provided at the upper and lower sides of the elongated hole 108, the relative position changes within the range corresponding to the margins.

The fixing mechanism 12 will now be described with reference to FIG. 14. The fixing mechanism 12 is a mechanism which is coupled to the engaged portion 62, which includes the second connection shaft 68 of the frame 6, to fix the frame 6 to the drum shell 2. As shown in FIG. 14, a joining member 132 having an L-shaped cross section is provided on the lower surface of the lower plate 36. The joining member 132 is provided with a latching member 134 having a C-shaped distal end 133. The second connection shaft 68 of the frame 6 is latched by the distal end 133.

In the same manner as the fine adjustment bolt 126 of the operating mechanism 11, the fixing mechanism 12 also has a fine adjustment bolt 135 for finely adjusting the position of the frame 6 when the snare wires 7 are in contact with the lower head 4. The fine adjustment bolt 135 extends through the upper plate 35 and the lower plate 36 and is fastened to the latching member 134. A sleeve 136 is arranged between the fine adjustment bolt 135 and the upper plate 35. An adjusting spring 137 is arranged around the fine adjustment bolt 135 below the lower plate 36. Accordingly, the fastening amount of the fine adjustment bolt 135 relative to the latching member 134 is adjusted by rotating the fine adjustment bolt 135. This finely adjusts the distance between the lower plate 36 and the latching member 134.

Covers 138 and 139 cover the latching members 122 and 134 of the operating mechanism 11 and the fixing mechanism 12, respectively. The cover 138 covers the operating portion 124 of the latching member 122 to prevent the latching member 122 from being released from the first connection shaft 65 when the operating portion 124 is accidentally pushed.

With regard to the drum 1 having the above snare wire unit, the procedure for attachment and detachment of the frame 6 on the lower head 4 and the operation of the snare wire unit will now be described.

The attachment of the frame 6 to the lower head 4 will first be described with reference to FIG. 14. In a state in which the operation lever 14 is located at the lowermost position as shown by the broken lines in FIG. 14, the second connection shaft 68 of the frame 6 is latched at the distal end 133 of the latching member 134 of the fixing mechanism 12. In this state, the frame 6 is pivotal about the second connection shaft 68 towards and away from the lower head 4. The snare wires 7 are separated from the lower head 4.

In this state, the frame 6 is moved toward the lower head 4 so that the first connection shaft 65 of the frame 6 approaches the latching member 122 of the operating mechanism 11. The first connection shaft 65 is then latched at the distal end 123 of the latching member 122. When the first connection shaft 65 comes into contact with the distal end 123 from the outer side (right side in FIG. 14) of the distal end 123, the latching member 122 pivots slightly clockwise against the force of the spring 125. Then, when the first connection shaft 65 is fitted in the distal end 123, the latching member 122 is pivoted counterclockwise by the force of the spring 125 and the distal end 123 is hooked to the first connection shaft 65 and locked in such a state.

At this stage, as shown in FIG. 14, the frame 6 is fixed to the drum 1 but the snare wires 7 are still separated from the lower head 4. If the drum 1 is to be played without using the resonance of the snare wires 7, the drum 1 is used in this state, or in a state in which the snare wires 7 are inactive.

Then, the operation lever 14 is lifted in a state in which the snare wires 7 are separated from the lower head 4. This pushes the coupling shaft 110 upward with the link 114. The upward movement of the coupling shaft 110 is transferred to the slide member 107. This lifts the slide member 107. As the slide member 107 moves upward, the arm 115, the coupling arm 120, and the operation shaft 116 lift the latching member 122. The upward movement of the latching member 122 causes the frame 6 to move toward the lower head 4 until the snare wires 7 come into contact with the lower head 4.

When the coupling point P of the link mechanism formed by the operation lever 14 and the link 114 moves toward the drum shell 2 beyond a dead point lying on a hypothetic line extending through the axes of the support shaft 111 and the coupling shaft 110, a reaction force of the force pushing the frame 6 toward the lower head 4, that is, a force pulling the slide member 107 downwards, is converted to a force that rotates the operation lever 14 counterclockwise in FIGS. 14 and 15. Due to the force, the operation lever 14 abuts against the rubber stopper 142 on the slide member 107 (see FIG. 15) and is locked in a state in which the frame 6 is located near the lower head 4.

To increase the force applied to the frame 6 in the locked state, the rubber washer 95 (see FIG. 16) is arranged on the upper surface of the coupling shaft 110 so that a larger downward force is applied to the slide member 107 at a position beyond the dead point. A reaction force generated when the rubber washer 95 is deformed by the wall of the elongated hole 94 of the bracket 104 functions as a force downwardly pushing the coupling shaft 110 and the slide member 107, which is coupled to the coupling shaft 110. This increases the force acting on the frame 6 in the locked state.

When using the resonance of the snare wires 7 to play the drum 1, the drum 1 is played in this state, that is, in a state in which the snare wires 7 are active.

In this manner, the simple operation of latching the latching members 122 and 134 to the corresponding first and second connection shafts 65 and 68, which are arranged on opposite ends of the frame 6, enables the engaged portions 61 and 62 of the frame 6 to be engaged with the frame attachment mechanism 10. In other words, the frame 6 is easily attached to the lower head 4 by just hooking the opposite ends of the frame 6 to the drum shell one after the other.

To detach the frame 6 from the lower head 4, the operation lever 14 is moved downward so that the snare wires 7 become inactive as shown in the state of FIG. 14. The operating portion 124 of the latching member 122 is then pressed with a finger towards the drum shell 2. As a result, the latching member 122 is pivoted around the operation shaft 116 towards the drum shell 2, and the distal end 123 of the latching member 122 is separated from the first connection shaft 65. This releases the latching member 122 from the first connection shaft 65. The second connection shaft 68 is then pulled out from the distal end 133 of the latching member 134 in a radially outward direction of the drum shell 2. This releases the latching member 134 from the second connection shaft 68. In the above embodiment, the frame 6 is attached and detached when the snare wires 7 are in an inactive state. However, the attachment and detachment of the frame 6 may also be performed when the snare wires 7 are in an active state.

As described above, the detachment of the frame 6 from the lower head 4 is also performed through an extremely simple operation. The operating portion 124 is first pressed to remove the frame 6 from the side closer to the operating mechanism 11 and then the side closer to the fixing mechanism 12. Accordingly, the frame 6 is attached to and detached from the lower head 4 in an extremely simple manner.

The above embodiment has the advantages described below.

(1) In the above embodiment, the first and second connection shafts 65 and 68 are arranged at the two ends of the frame 6, and the latching members 122 and 134 shaped to enable engagement with the shafts 65 and 68 are arranged in the frame attachment mechanism 10. Accordingly, the engaged portions 61 and 62 at the two ends of the frame 6 are easily engaged with the frame attachment mechanism 10 by a simple operation of latching the latching members 122 and 134 to the shafts 65 and 68. As a result, the attachment and detachment of the frame 6 is easily performed and thus the task is simplified.

(2) The latched members (first and second connection shafts 65 and 68) engaged with the frame attachment mechanism 10 are shaft-shaped. This simplifies the structure for hooking or fitting the latching members 122 and 134 at the side of the frame attachment mechanism 10.

(3) The operating mechanism 11 of the above embodiment is arranged on the base plate 101, which is located between the reinforcing ring 21 and the ring member 16 and separated from the drum shell 2 by a predetermined distance. Therefore, the load produced when the operation lever 14 is manipulated or the frame 6 is attached is not directly applied from the operating mechanism 11 to the drum shell 2. Therefore, the drum shell 2 is not deformed by such loading, and the sound of the drum 1 is not affected by such deformation.

(4) In the above embodiment, the latching member 122 of the operating mechanism 11 is constantly urged by the spring 125 in a radially outward direction of the drum shell 2. Therefore, engagement of the first connection shaft 65 and the latching member 122 against the urging force latches the first connection shaft 65 and the latching member 122 to each other.

(5) In the embodiment above, the snare wires 7 are held by the frame 6, and the collective adjustment mechanism 39 and the individual adjustment mechanism 40 for adjusting the tension of the snare wires 7 are arranged on the frame 6 so that they are completely independent from the drum shell 2 of the drum 1. Accordingly, the tension of the snare wires 7 does not vary before or after detachment of the frame 6. Thus, further tension adjustment is not required when the frame 6 is re-attached to the drum 1 after being detached from the frame 6.

(6) Further, the tension of the snare wires 7 is received by the frame 6. Thus, the tension is not applied to the drum shell 2 of the drum 1 or the operation lever 14. Accordingly, this strength is not required to operate the operation lever 14. Further, deformation of the drum shell 2 that would affect the sound of the drum 1 does not occur.

(7) In the above embodiment, the latching member 122 has two hook-shaped distal ends 123, as shown in FIG. 18, so that the first connection shaft 65 is latched at two locations. Therefore, the first connection shaft 65 and the latching member 122 are engaged with each other more stably in comparison to when the first connection shaft is latched at one location.

(8) In the above embodiment, the snare wires 7 are fitted in the fitting grooves 41, 43, and 45 as shown in FIGS. 7 through 9, and the cylindrical metal sleeves 57 at the ends of the snare wires 7 abut against the abutment portions 60 and are locked by the projections 71. The ends of the individual snare wires 7 are fitted in the fitting grooves 41, 43, and 45 independently from each other through the openings 41*a*, 43*a*, and 45*a*. Therefore, the attachment and detachment of each snare wire 7 is easily performed. This enables the number of the snare wires 7 to be decreased and then returned to the original number.

(9) In the above embodiment, the frame 6 is provided with the two dampers 8. Thus, the resonance of the snare wires 7 may easily be adjusted whenever the drum 1 is played. Further, the dampers 8 are each designed such that the pressure of the pad 84 applied to the snare wires 7 is adjusted by tightening or loosening the lower operating screw 85. Therefore, the level of resonance may be adjusted in accordance with the drummer's preference. Further, the dampers 8 may be moved in the longitudinal direction of the frame 6 by loosening the rear operating screw 86. Therefore, any desired tone can be obtained by adjusting the position of the damper 8.

(10) In the above embodiment, as shown in FIG. 10, the pressing shafts 69 and 70 are arranged in the right side portion 6*a* and the left side portion 6*b* of the frame 6, respectively. Therefore, the height of the snare wires 7 are adjusted to contact the head surface in a uniform manner.

(11) In the above embodiment, the cover 138 covers the operating portion 124 of the latching member 122. This prevents the frame 6 from being detached from the drum 1 when the latching member 122 is accidentally released from the first connection shaft 65.

(12) In the above embodiment, the switching device 13, which includes the operation lever 14, is arranged on the base plate 101 between the reinforcing ring 21 and the ring member 16. Accordingly, the operation lever 14 is arranged on the upper part of the drum 1. Thus, the operation lever 14 is located at a position where it can easily be operated during marching.

It should be apparent to those skilled in the art that the present invention may be embodied in many other specific forms without departing from the spirit or scope of the invention. Particularly, it should be understood that the present invention may be embodied in the following forms.

In the above embodiment, the first connection shaft 65 and the distal end of the latching member 122 are latched together and locked by the urging force of the spring when attaching the frame 6 to the drum 1. However, the frame 6 may be manually attached by pressing the operating portion 124 of the latching member 122 with a finger as when detaching the frame 6 in a state in which the distal end 123 is separated from the first connection shaft 65.

The snare wires 7 do not necessarily have to be formed from stringing and may be formed from metal wire or coil spring.

The latched members (the first connection shaft 65 and the second connection shaft 68) arranged at the ends of the frame 6 and the latching members 122 and 134 do not necessarily have to be shaft-shaped or hook-shaped. It is only required that the latching members and the latched members are shaped such that they can be latched with each other. Thus, the latched and latching members may be modified. For example, the latched and latching members may both be hook-shaped. Alternatively, the latched members may be hook-shaped, and the latching member may be shaft-shaped.

In the above embodiment, the latching member 122 has two hook-shaped distal ends 123 so as to hook the first connection shaft 65 at two locations. However, the latching member 122 may have only one distal end 123.

The covers 138 and 139 in the above embodiment may be omitted.

The present examples and embodiments are to be considered as illustrative and not restrictive, and the invention is not to be limited to the details given herein, but may be modified within the scope and equivalence of the appended claims.

What is claimed is:

1. A snare drum for use with a plurality of snare wires, the snare drum comprising a drum shell having an upper head and a lower head mounted thereon, an outer side, and a frame for holding the plurality of snare wires, the frame arranging the snare wires to be in contact with the lower head or to be spaced from the lower head, the snare drum including:

a first latched member and a second latched member respectively located at opposite ends of the frame at the outer side of the drum shell; and an attachment mechanism located on the drum shell for arranging the frame on a surface of the lower head, the attachment mechanism including;

a first latching member and a second latching member arranged between the drum shell and the first and second latched members for latching the first and second latched members, respectively;

wherein the second latched member is shaft-shaped, and the frame is supported pivotally about the second latched member while the second latching member is latched to the second latched member; and wherein the attachment mechanism associated with the first latching member includes a switching device for switching the frame, in a state in which the second latching member is latched to the second latched member, between an engagement position in which the snare wires are in contact with the lower head and a disengagement position in which the snare wires are spaced from the lower head, the switching of the frame causing a pivotal movement of the frame about the second latched member.

2. The snare drum according to claim 1, wherein:

the first latching member is movable between a latch position where the first latching member latches the first latched member and a release position where the first latching member is released from the first latched member; and the attachment mechanism includes an urging means for urging the first latching member toward the latch position by exerting an urging force, and an operating portion for moving the first latching member toward the release position against the urging force of the urging means.

3. The snare drum according to claim 2, further comprising:

an operation shaft supporting the first latching member pivotally between the latch position and the release position.

4. The snare drum according to claim 1, wherein each of the snare wires has a first end and a second end, and the frame has a first end and a second end respectively corresponding to the first and second ends of each snare wire, the frame including:

an individual adjustment mechanism for individually adjusting tension of each snare wires at the first end of the frame; and a collective adjustment mechanism for collectively adjusting the tension of all the snare wires at the second end of the frame.

5. The snare drum according to claim 4, wherein the individual adjustment mechanism includes a groove for each snare wire, the first end of each snare wire being fitted in its respective groove, and a lock portion for locking the first end of the snare wire fitted in said groove.

6. The snare drum according to claim 4, wherein the collective adjustment mechanism has a groove for each snare wire, the second end of each snare wire being fitted in its respective groove, and a lock portion for locking the second end of the snare wire fitted in said groove.

7. The snare drum according to claim 4, wherein the frame includes an adjustment member for aligning the snare wires so that the snare wires uniformly contact the lower head.

8. The snare drum according to claim 1, wherein the frame includes a damper for suppressing resonance of the snare wires.

9. The snare drum according to claim 8, wherein the damper is mounted on the frame such that the damper is movable along a longitudinal direction of the frame.

10. The snare drum according to claim 8, wherein the damper includes a pad for suppressing resonance of the snare wires when pressed against the snare wires, and an adjustment mechanism for adjusting the distance between the pad and the snare wires.

11. The snare drum according to claim 1, wherein the drum shell includes:

a plurality of tension pipes arranged around the drum shell at predetermined intervals, with each tension pipe including upper and lower ends;

a lower ring member extending around the drum shell and connected to the lower end of each tension pipe; and an upper ring member extending around the drum shell and connected to the upper end of each tension pipe, the lower and upper ring members supporting the attachment mechanism in a state separated from the drum shell.

12. The snare drum according to claim 2, wherein the attachment mechanism includes a cover for covering the operating portion.

* * * * *